US011596028B2

(12) United States Patent
Reevell

(10) Patent No.: US 11,596,028 B2
(45) Date of Patent: Feb. 28, 2023

(54) CARTRIDGE FOR AN AEROSOL-GENERATING SYSTEM WITH IDENTIFICATION INDUCTOR

(71) Applicant: Altria Client Services LLC, Richmond, VA (US)

(72) Inventor: Tony Reevell, London (GB)

(73) Assignee: Altria Client Services LLC, Richmond, VA (US)

( * ) Notice: Subject to any disclaimer, the term of this patent is extended or adjusted under 35 U.S.C. 154(b) by 171 days.

(21) Appl. No.: 16/864,697

(22) Filed: May 1, 2020

(65) Prior Publication Data

US 2020/0253284 A1 Aug. 13, 2020

Related U.S. Application Data

(60) Division of application No. 15/351,745, filed on Nov. 15, 2016, now Pat. No. 10,674,764, which is a (Continued)

(30) Foreign Application Priority Data

Nov. 17, 2015 (EP) ..... 15194893

(51) Int. Cl.
*H05B 1/02* (2006.01)
*A24F 40/42* (2020.01)
(Continued)

(52) U.S. Cl.
CPC ..... *H05B 1/0227* (2013.01); *A24F 40/42* (2020.01); *A24F 40/53* (2020.01); *A24F 40/70* (2020.01); *A24F 40/10* (2020.01)

(58) Field of Classification Search
CPC ..... A24F 40/10; A24F 40/50; A24F 40/20; A24F 40/53; A24F 40/46; A24F 40/42;
(Continued)

(56) References Cited

U.S. PATENT DOCUMENTS 5,826,570 A 10/1998 Goodman et al.
6,019,461 A 2/2000 Yoshimura et al.
(Continued)

FOREIGN PATENT DOCUMENTS

CN 1280661 A 1/2001
CN 203087525 U 7/2013
(Continued)

OTHER PUBLICATIONS

Notice of Grounds for Rejections dated Oct. 12, 2020 in Japanese Application No. 2018-544405.
(Continued)

*Primary Examiner* — Tu B Hoang
*Assistant Examiner* — Vy T Nguyen
(74) *Attorney, Agent, or Firm* — Harness, Dickey & Pierce, P.L.C.

(57) ABSTRACT

In a method of manufacturing a cartridge of an electronic vaping device, wherein the cartridge includes a pre-vapor formulation storage element, an electrical inductor is formed from an electrical component, wherein the electrical inductor has an inductance indicative of a pre-vapor formulation substrate contained in the pre-vapor formulation storage element. The electrical inductor is then mounted to the cartridge.

10 Claims, 3 Drawing Sheets

Related U.S. Application Data continuation of application No. PCT/EP2016/075852, filed on Oct. 26, 2016.

(51) Int. Cl.
*A24F 40/70* (2020.01)
*A24F 40/53* (2020.01)
*A24F 40/10* (2020.01)

(58) Field of Classification Search
CPC ..... A24F 40/40; A24F 40/44; A24F 40/465; A24F 40/51; A24F 40/60; A24F 40/485; A24F 40/65; A24F 40/30; A24F 40/57; A24F 40/95; A24F 40/48; A24F 40/90; A24F 40/00; A24F 40/05; A24F 40/80; A24F 40/85; A24F 47/00; A24F 7/02; H05B 1/0244; H05B 2203/021; H05B 3/44; H05B 2203/022; H05B 1/0227; H05B 3/04; H05B 1/0297; H05B 2203/014; H05B 3/06; H05B 6/06; H05B 2206/023; H05B 6/108; H05B 1/02; H05B 1/0208; H05B 2203/013; H05B 2206/02; H05B 3/0014; H05B 3/03; H05B 3/12; H05B 3/145; H05B 3/26; H05B 3/42; H05B 3/46; H05B 41/2827; H05B 41/391; H05B 6/04; H05B 6/105; H05B 6/106; H05B 6/36; A24D 1/20; A24D 1/02; A24D 3/17
USPC ..... 219/219, 231, 240, 263, 269, 433; 392/394, 387, 395, 404; 131/329, 328, 131/360, 194, 361, 184.1, 271, 273, 330, 131/334, 365; 338/338, 309, 35, 195, 338/226, 22 R, 254, 262, 276, 307, 313, 338/314, 322, 52, 9; 116/116, 216
See application file for complete search history.

(56) References Cited

U.S. PATENT DOCUMENTS

| | | | | |
|---|---|---|---|---|
| 2005/0024290 | A1 | 2/2005 | Aisenbrey | |
| 2005/0121495 | A1 | 6/2005 | Yokoyama | |
| 2007/0247270 | A1 | 10/2007 | Fushimi et al. | |
| 2014/0123989 | A1* | 5/2014 | LaMothe | A61M 15/0003 131/328 |
| 2014/0253144 | A1* | 9/2014 | Novak, III | A24F 40/53 324/550 |
| 2014/0270727 | A1 | 9/2014 | Ampolini et al. | |
| 2014/0292294 | A1 | 10/2014 | Kihara et al. | |
| 2014/0338685 | A1 | 11/2014 | Amir | |
| 2015/0075545 | A1 | 3/2015 | Xiang | |
| 2017/0095003 | A1 | 4/2017 | Mironov | |
| 2017/0367410 | A1* | 12/2017 | Hon | H05B 1/0297 |

FOREIGN PATENT DOCUMENTS

| | | | | |
|---|---|---|---|---|
| CN | 203314106 | U | 12/2013 | |
| CN | 204273243 | U | 4/2015 | |
| CN | 105050434 | A | 11/2015 | |
| EP | 2399636 | A1 | 12/2011 | |
| EP | 2468118 | A1 | 6/2012 | |
| WO | WO-2011/160788 | A1 | 12/2011 | |
| WO | WO-2011160788 | A1 * | 12/2011 | A24F 47/008 |
| WO | WO-2013/083638 | A1 | 6/2013 | |
| WO | WO-2014/071329 | A1 | 5/2014 | |
| WO | WO-2014201432 | A1 | 12/2014 | |
| WO | WO-2015/015431 | A1 | 2/2015 | |
| WO | WO-2015/035674 | A1 | 3/2015 | |
| WO | WO-2015/155289 | A1 | 10/2015 | |

OTHER PUBLICATIONS

Office Action dated May 25, 2020 in Chinese Application No. 201680062925.6.
Extended European Search Report for European Application No. 15194893.2-1656 dated Jun. 5, 2016.
International Search Report and Written Opinion of the International Searching Authority dated Jan. 23, 2017 in PCT/EP2016/075852.
International Preliminary Report on Patentability dated Mar. 14, 2018 in International Application No. PCT/EP2016/075852.
Written Opinion of the International Preliminary Examining Authority dated Oct. 26, 2017 in International Application No. PCT/EP2016/075852.
Decision to Grant dated Dec. 19, 2019 in Russian Application No. 2018121832/12 (034543).
Search Report dated Nov. 18, 2019 in Russian Application No. 2018121832/12 (034543).
Non-Final Office Action dated Jun. 27, 2019 in U.S. Appl. No. 15/351,745.
Notice of Allowance dated Nov. 1, 2019 in U.S. Appl. No. 15/351,745.
Notice of Allowance dated Feb. 10, 2020 in U.S. Appl. No. 15/351,745.
Decision to Grant dated May 17, 2021 in Japanese Application No. 2018-544405.

* cited by examiner

CARTRIDGE FOR AN AEROSOL-GENERATING SYSTEM WITH IDENTIFICATION INDUCTOR

CROSS-REFERENCE TO RELATED APPLICATIONS

This application is a Divisional Application of U.S. application Ser. No. 15/351,745, filed on Nov. 15, 2016, which is a Continuation of, and claims priority to, international application no. PCT/EP2016/075852, filed on Oct. 26, 2016, and further claims priority under 35 U.S.C. § 119 to European Patent Application No. 15194893.2, filed Nov. 17, 2015, the entire contents of each of which are incorporated herein by reference.

BACKGROUND

Field

Example embodiments relate to methods of manufacturing cartridges for use with an aerosol-generating system. In at least some example embodiments, the cartridge is provided with an identification inductor having an inductance indicative of the cartridge or the aerosol-forming medium stored in the cartridge.

Description of Related Art

Electronic vaping or e-vaping devices have a modular construction and include a replaceable cartridge with a storage component for holding an aerosol-forming substrate. The aerosol-forming substrate comprised in the cartridge may vary considerably in composition, flavor, strength and/or other characteristics. Adult vapers may wish to interchange cartridges at will. However, optimum vaporization conditions may depend on the composition of the aerosol-forming substrate comprised in the cartridges. Thus, in order to adapt the vaporization unit to the specific aerosol-forming substrate chosen by the adult vaper, it may be desirable for the e-vaping device to be able to automatically identify the replaceable cartridge or the aerosol-forming substrate stored therein, in order to automatically change the control settings of the vaporization equipment accordingly.

An aerosol generator may include a replaceable cartridge having one or more electrical components for distinguishing the cartridge from other cartridges. The electrical components may be one or more electrical resistors, capacitors or inductors. The aerosol generator includes the ability to determine the electrical characteristics of the one or more electrical components. The aerosol generator may further comprise a look-up table stored in a memory unit, in which the characteristics of the electrical components are associated with data identifying the respective cartridge. In order to allow for distinguishing between different cartridges, a plurality of electrical components may be used.

Additional electrical components for distinguishing the cartridge from other cartridges may be provided in separate electrical circuits, and thus, may require the use of additional electric contacts through which the additional electrical components are connected to the control circuitry. Additional contacts may increase complexity of the structure of the aerosol-generating system, which may increase production costs and represent an additional source for malfunction.

SUMMARY

One or more example embodiments may provide a more reliable method for manufacturing electronically distinguishable cartridges with only little or no increase in structural complexity.

At least one example embodiment provides a method of manufacturing a cartridge suitable for use with an aerosol-generating system (also referred to as an electronic vaping or e-vaping device/system), the method comprising: providing a liquid storage portion (also referred to as a pre-vapor formulation storage element); providing an electrical component having a desired (or, alternatively, pre-defined) resistance; forming the electrical component into an electrical inductor having a desired inductance; and mounting the electrical inductor to the cartridge. The inductance of the electrical inductor is indicative of the particular cartridge. The inductance of the electrical inductor may also be indicative of an aerosol-forming substrate (also referred to as a pre-vapor formulation substrate or pre-vapor formulation) filled in, or to be filled in, the liquid storage portion of the cartridge.

The electrical component may be a suitably shaped, electrically conductive wire. For a given material, the total resistance of an electrically conductive wire is determined by its cross-section and its length. The wire may be made from a conductive material having relatively low resistivity, such as copper, silver, aluminium, alloys thereof, or the like. The lower the resistance of the electrical component, the less electrical energy that is dissipated in the electrical component and the lower the influence of the electrical component to the remaining electrical circuit.

The electrically conductive wire may be formed into a solenoid, such as an inductive coil, having a particular inductance. The resulting inductance of a coil formed from an electrically conductive wire depends on the length, the radius and the number of turns of the inductive coil. In this way, a plurality of identical wires, (e.g., wires made from identical material), with identical cross-section and identical length, may be formed into a plurality of inductive coils with differing inductance. As the length of the wires remains the same or substantially the same (e.g., unchanged), the total resistance of the inductive coils also remains substantially constant. In this context "substantially constant" means that the total resistance is substantially the same or identical, and generally only varies due to material inhomogeneity or production tolerances.

In order to manufacture the wires into coils with varying inductance, at least one of the number of turns, the diameter of the coil, and the overall length of the coil may be changed. If the full length of the wire is formed into coil shape, a change of one of the parameters also leads to a change of the other parameters. However, the full length of the wire need not be formed into coil shape. At least one of the parameters coil diameter, coil length and number of turns may be maintained constant or substantially constant. The excess wire portion that is not formed into coil shape may then be used, for example, to connect the cartridge circuit to the power source contacts.

According to at least some example embodiments, the method may further comprise: providing an electrical heating element; mounting the electrical heating element to the cartridge and connecting an electrical inductor in series to the electrical heating element. Throughout this specification, the combination of the heating element and the inductor may be referred to as a "cartridge circuit".

The heating element may be powered in aerosol-generating systems by a direct current (DC) power source. Such direct current electric circuits may be only marginally influenced by the presence of an additional inductance. Moreover, if the inductive element is made from a relatively low resistivity material, then the total resistance also may only have a negligible influence on the power consumption and may not affect the heater properties of the heating element.

In one or more example embodiments in which heating elements are powered by direct current (DC) power sources, such as batteries, the voltage drop across and the current flow through the heating element may be substantially constant during use. However, in order to determine the inductance of the inductor, the response of the inductor upon a change of the current flow is determined. The inductance may be determined upon activation or deactivation of the electric circuit or by applying alternating current. Thus, determination of the inductance and identification of the cartridge may be carried out at times when the heating element is inactive.

During operation, the cartridge circuit is connected to a power source and is controlled by the electric circuitry of the aerosol-generating system. The electrical contacts for contacting the cartridge circuit to the control circuitry may be provided as point contacts, rectangular contacts, circular contacts, concentric ring contacts, etc. Smaller contact areas allow for a compact construction, but may require that the cartridge resumes a specific orientation in order to close the contact. In contrast thereto, larger contact areas (e.g., ring contacts) do not require a specific orientation of the cartridge, and therefore, may simplify handling of the system for adult vapers.

According to one or more example embodiments, the inductive element may be connected in series with the heating element, and therefore, two electric contacts may be sufficient in order to power the heating device and to determine the inductance of the electric inductor. This may reduce complexity and/or increase reliability and/or performance of the system.

If the various inductive components are formed from an identical piece of wire, then the manufacturing method and the logistics involved during manufacture may be simplified (e.g., significantly simplified). Instead of providing a plurality of differing inductive components for the manufacturing process, methods according to one or more example embodiments require only one electrical component, such as an electrically conductive wire. This wire is then formed, during manufacturing of the cartridge, into inductive components with differing particular inductances.

During manufacturing, each cartridge is equipped with a specific inductive component, whose inductance is indicative of the aerosol-forming substrate that is already included or that is to be filled in the liquid storage portion of the cartridge.

The electrical inductor may be mounted to the cartridge at any suitable position. The electrical inductor may be mounted on the inside of the cartridge, such that the inductor is not accessible by the adult vaper during normal replacement handling of the cartridge.

The electrical inductor may also be mounted on the outside of the cartridge. In order to further protect the inductor in this case from unwanted or inadvertent manipulation, the cartridge may further be provided with a cap which is adapted to cover the electrical inductor.

In one or more example embodiments in which the heating element is provided in the form of a heating coil, the inductance of the heating circuit may also be varied by modification of the heating coil itself. The variation of the inductance of the heating coil follows the same principles as the modification of the inductance of the additional electrical inductor as described above. By varying the inductance of the heating coil, a separate inductor is not required. However, the design of the heating coil needs also to comply with certain requirements of the atomizing and/or vaporization process, such as the diameter and the length of the wick portion to be heated. Accordingly, less degree of freedom is available for the variation of the dimensions of the coil.

At least one other example embodiment provides a cartridge suitable for use with an aerosol-generating system, wherein the cartridge comprises a liquid storage portion and an electrical inductor having a desired (or, alternatively, pre-defined) resistance and a particular inductance, wherein the particular inductance of the electrical inductor is indicative of the employed cartridge or the aerosol-forming substrate comprised in or to be filled in the liquid storage portion of the cartridge.

The cartridge may further comprise a heating element, which is electrically connected in series to the electrical inductor; wherein the heating element and the electrical inductor form a cartridge circuit.

At least one example embodiment provides an aerosol-generating system comprising a cartridge and a device portion. The cartridge comprises a liquid storage portion and an electrical inductor having a desired (or, alternatively, pre-defined) resistance and a particular inductance, wherein the particular inductance of the electrical inductor is indicative of the employed cartridge or the aerosol-forming substrate comprised in or to be filled in the liquid storage portion of the cartridge. The device portion includes a power supply and an electronic circuitry. The electronic circuitry is configured to determine the electrical inductance of the electric inductor, and to associate the electrical inductance with data identifying the cartridge.

The cartridge and the device portion may be separate or individual bodies or units. In other words, for example, the cartridge may be manufactured, packaged and sold separately of the device portion. The cartridge may be mountable to the device portion or receivable by the device portion. As such, the device portion may durable and may be configured for multiple uses, and the cartridge may be replaceable after one or two uses. In at least some example embodiments, the device portion may be configured to be used with different cartridges.

The cartridge may be releasably or detachably mountable to a device portion of an aerosol-generating system. The cartridge may be releasably or detachably mounted to the device portion of the aerosol-generating system.

In at least one example embodiment, the cartridge is a replaceable tank, which includes an electrical inductor identifying the tank and the aerosol-forming substrate contained therein, while the heating element may form part of the device portion. The liquid from the tank is conveyed to the heating element by a suitable passive or active conveyor. A passive conveyor (or, alternatively, a conveying means) may include a capillary tube or wick, which extends into the replaceable tank and which forwards or conveys the aerosol-forming substrate to the heating element by capillary action. An active conveyor may include pumps or syringe systems, which may be actively controlled by a control circuit. Such active conveyors may be activated in response to a corresponding signal from a sensor (also referred to as a puff sensor).

In some example embodiments in which the heating element forms part of the device portion, the heating element is not replaced upon replacement of the tank. However, it may be possible that the heating element is replaceably mounted to the device portion, such that the adult vaper may insert a new heating element when necessary.

The device portion may comprise a memory device storing a look-up table. The look-up table may include data representing or indicative of electrical inductance values of the inductors, wherein each electrical inductance value is associated with data identifying a cartridge and/or a pre-vapor formulation contained in the cartridge.

The look-up table may further comprise data representing or indicative of one or more inductance values, wherein each inductance value is further associated with parameters representing a different energy profile to be applied to the heating element. Each inductance value may be associated with a different cartridge identifier. Accordingly the aerosol-generating system (also referred to as an electronic vaping device) may be configured to output a constant or substantially constant amount (e.g., volume or mass of aerosol or vapor) through an outlet at the mouth-end piece even when cartridges containing different aerosol-forming substrates are inserted into the aerosol-generating system.

For example, a particular aerosol-forming substrate contained within one cartridge may require more energy to be vaporized, than a different aerosol-forming substrate contained within another cartridge. By associating an inductance value or a particular cartridge identifier with a heating profile stored in a look-up table, a constant or substantially constant amount of aerosol may be output through an outlet independent of the type of aerosol-forming substrate stored in the cartridge.

At least one example embodiment provides a method of manufacturing a cartridge of an electronic vaping device, the cartridge including a pre-vapor formulation storage element, the method comprising: forming an electrical inductor from an electrical component, the electrical inductor having an inductance indicative of a pre-vapor formulation substrate contained in the pre-vapor formulation storage element; and mounting the electrical inductor to the cartridge.

The electrical component may be a wire composed of a conductive material. The conductive material may be copper, silver, aluminium or an alloy thereof.

The electrical inductor may be an inductive coil.

The method may further comprise: mounting an electrical heating element to the cartridge; and electrically connecting the electrical inductor in series with the electrical heating element.

At least one other example embodiment provides a method of manufacturing a cartridge of an electronic vaping device, the cartridge including a pre-vapor formulation storage element, the method comprising: selecting an electrical inductor, from a plurality of electrical inductors, based on a pre-vapor formulation substrate contained in the pre-vapor formulation storage element, the plurality of electrical inductors having a same electrical resistance and differing electrical inductances; and mounting the electrical inductor to the cartridge.

The plurality of electrical inductors may be in the form of a plurality of solenoids; the method may further include forming the plurality of solenoids from a plurality of identical wires; and the plurality of solenoids differ by at least one of (i) a number of turns, (ii) a diameter of the turns, and (iii) an overall length.

At least one other example embodiment provides a cartridge for an electronic vaping device, the cartridge comprising: a pre-vapor formulation storage element containing a pre-vapor formulation substrate; and an electrical inductor an inductance indicative of the pre-vapor formulation substrate contained in the pre-vapor formulation storage element.

The cartridge may further comprise: a heating element electrically connected in series with the electrical inductor to form a cartridge circuit.

At least one other example embodiment provides an electronic vaping device comprising: a pre-vapor formulation storage element containing a pre-vapor formulation substrate; an electrical inductor having an inductance indicative of the pre-vapor formulation substrate contained in the pre-vapor formulation storage element; a heating element electrically connected in series with the electrical inductor to form a cartridge circuit; and electronic control circuitry configured to determine an electrical inductance value of the cartridge circuit, and to identify the pre-vapor formulation substrate contained in the pre-vapor formulation storage element based on data associated with the electrical inductance value.

The electronic vaping device may further comprise: a power supply configured to supply power to the electrical inductor, the heating element and the electronic control circuitry.

The electronic vaping device may further comprise: a cartridge including the pre-vapor formulation storage element, the electrical inductor, and the heating element; and a control section detachably coupled to the cartridge, the control section including the electronic control circuitry. Alternatively, the electronic vaping device may comprise: a cartridge including the pre-vapor formulation storage element and the electrical inductor; and a control section detachably coupled to the cartridge, the control section including the heating element and the electronic control circuitry.

The control section may further include a power supply configured to supply power to the cartridge and the control section.

First electrical contacts at an end of the cartridge may be electrically connected to second electrical contacts at an end of the control section. The first and second electrical contacts may be point contacts, rectangular contacts, circular contacts, or concentric ring contacts.

The end of the cartridge may include exactly two first electrical contacts; the end of the control section may include exactly two second electrical contacts; and the first electrical contacts and the second electrical contacts may be configured to provide power to the heating element and allow for determining the electrical inductance value of the cartridge circuit while providing power to the heating element.

The electronic vaping device may further comprise a memory storing a look-up table. The look-up table may include data indicative of electrical inductance values for a plurality of electrical inductors, each of the electrical inductance values associated with data identifying a type of pre-vapor formulation substrate.

BRIEF DESCRIPTION OF THE DRAWINGS

Example embodiments will be further described, by way of example only, with reference to the accompanying drawings in which.

DETAILED DESCRIPTION

Figures 1A, 1B:
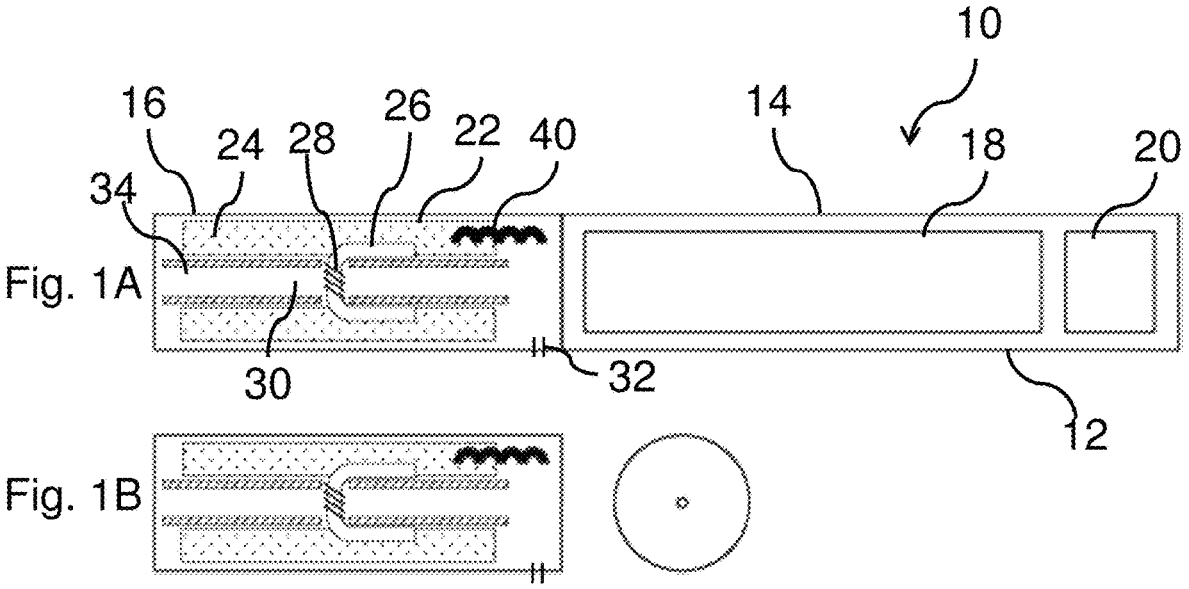
FIG. 1A shows an example embodiment an aerosol generating system including an inductor mounted to a cartridge.
FIG. 1B illustrates an example embodiment of the cartridge shown in FIG. 1A.

Example embodiments will become more readily understood by reference to the following detailed description of the accompanying drawings. Example embodiments may, however, be embodied in many different forms and should not be construed as being limited to the example embodiments set forth herein. Rather, these example embodiments are provided so that this disclosure will be thorough and complete. Like reference numerals refer to like elements throughout the specification.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings set forth herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Example embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, these example embodiments should not be construed as limited to the particular shapes of regions illustrated herein, but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of this disclosure.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

In the following description, illustrative embodiments may be described with reference to acts and symbolic representations of operations (e.g., in the form of flow charts, flow diagrams, data flow diagrams, structure diagrams, block diagrams, etc.) that may be implemented as program modules or functional processes including routines, programs, objects, components, data structures, etc., that perform particular tasks or implement particular abstract data types. The operations be implemented using existing hardware in existing electronic systems, such as one or more microprocessors, Central Processing Units (CPUs), digital signal processors (DSPs), application-specific-integrated-circuits (ASICs), SoCs, field programmable gate arrays (FPGAs), computers, or the like.

Further, one or more example embodiments may be (or include) hardware, firmware, hardware executing software, or any combination thereof. Such hardware may include one or more microprocessors, CPUs, SoCs, DSPs, ASICs, FPGAs, computers, or the like, configured as special purpose machines to perform the functions described herein as well as any other well-known functions of these elements. In at least some cases, CPUs, SoCs, DSPs, ASICs and FPGAs may generally be referred to as processing circuits, processors and/or microprocessors.

Although processes may be described with regard to sequential operations, many of the operations may be performed in parallel, concurrently or simultaneously. In addition, the order of the operations may be re-arranged. A process may be terminated when its operations are completed, but may also have additional steps not included in the figure. A process may correspond to a method, function, procedure, subroutine, subprogram, etc. When a process corresponds to a function, its termination may correspond to a return of the function to the calling function or the main function.

As disclosed herein, the term "storage medium", "computer readable storage medium" or "non-transitory computer readable storage medium," may represent one or more devices for storing data, including read only memory (ROM), random access memory (RAM), magnetic RAM, core memory, magnetic disk storage mediums, optical storage mediums, flash memory devices and/or other tangible machine readable mediums for storing information. The term "computer-readable medium" may include, but is not limited to, portable or fixed storage devices, optical storage devices, and various other mediums capable of storing, containing or carrying instruction(s) and/or data.

Furthermore, at least some portions of example embodiments may be implemented by hardware, software, firmware, middleware, microcode, hardware description languages, or any combination thereof. When implemented in software, firmware, middleware or microcode, the program code or code segments to perform the necessary tasks may be stored in a machine or computer readable medium such as a computer readable storage medium. When implemented in software, processor(s), processing circuit(s), or processing unit(s) may be programmed to perform the necessary tasks, thereby being transformed into special purpose processor(s) or computer(s).

A code segment may represent a procedure, function, subprogram, program, routine, subroutine, module, software package, class, or any combination of instructions, data structures or program statements. A code segment may be coupled to another code segment or a hardware circuit by passing and/or receiving information, data, arguments, parameters or memory contents. Information, arguments, parameters, data, etc. may be passed, forwarded, or transmitted via any suitable means including memory sharing, message passing, token passing, network transmission, etc.

FIG. 1 illustrates an example embodiment of an aerosol-generating system (also referred to as an electronic vaping or e-vaping system/device) 10. The aerosol-generating system 10 of FIG. 1 is an electrically heated aerosol-generating system 10 and comprises a two-part housing 12 having a device portion (also referred to as a power supply section or control section) 14 and a cartridge 16. The device portion 14 includes an electric power supply in the form of a battery 18 and electric control circuitry (also referred to as electronic control circuitry, control circuitry or a controller) 20. The cartridge 16 comprises a liquid storage portion (also referred to as a pre-vapor formulation storage element) 22 containing aerosol-forming substrate (also referred to as a pre-vapor formulation substrate) 24, a capillary wick 26 and a heating element in the form of a heating coil (also referred to as a heating element) 28. In at least this example embodiment, the liquid storage portion 22 is a cylindrical structure defining a central air flow channel 30. The ends of the capillary wick 26 extend into the liquid storage portion 22. A central portion of the capillary wick 26 extends through the air flow channel 30 and is at least partially surrounded by the heating coil 28. The heating coil 28 is connected to the electric circuitry 20 via appropriate electrical connections (not shown). The housing 12 also includes an air inlet 32, and an air outlet 34 at the mouth-end piece. In the device depicted in FIG. 1B, the cartridge 16 is removable from the device portion 14, and comprises the liquid storage portion 22 and the vaporizer assembly 26, 28.

During vaping, the liquid aerosol-forming substrate 24 is transferred from the liquid storage portion 22 by capillary action from the ends of the wick 26, which extend into the liquid storage portion 22, to the central portion of the wick 26, which is surrounded by the heating coil 28. When an adult vaper applies negative pressure or negative pressure above a threshold (collectively referred to hereinafter as applying negative pressure) to the air outlet 34 at the mouth-end piece, ambient air is drawn through air inlet 32. A detection (puff detection) system (not shown) senses the negative pressure and activates the heating coil 28. As discussed herein, application of negative pressure and/or application of negative pressure above a threshold may be referred to as a puff. The battery 18 supplies electrical energy to the heating coil 28 to heat the central portion of the wick 26 surrounded by the heating coil 28. The aerosol-forming substrate 24 in the central portion of the wick 26 is vaporized by the heating coil 28 to create a supersaturated vapor. The supersaturated vapor is mixed with and carried in the air flow from the air inlet 32. In the air flow channel 30 the vapor condenses to form an inhalable aerosol (also referred to as a vapor), which is carried towards the outlet 34 and drawn through the air outlet 34.

The cartridge 16 further includes an inductor 40. The inductor 40 is connected to the control circuitry 20, and allows the control circuitry 20 to identify the liquid storage portion 22, including the type of aerosol-forming substrate 24 included or contained in the liquid storage portion 22. As shown in FIGS. 1A and 1B, the inductor 40 may be placed in the liquid storage portion 22. In at least this example embodiment, the inductor 40 is not visible to an adult vaper and is protected from damage during normal handling of the aerosol-generating system 10.

The aerosol-generating system 10 depicted in FIGS. 1A and 1B is only an example aerosol-generating system in which the cartridge may be used. The skilled person will readily appreciate that the identification system according to example embodiments may also be used with other known designs of aerosol-generating systems 10 employing replaceable cartridges 16.

Figure 2:
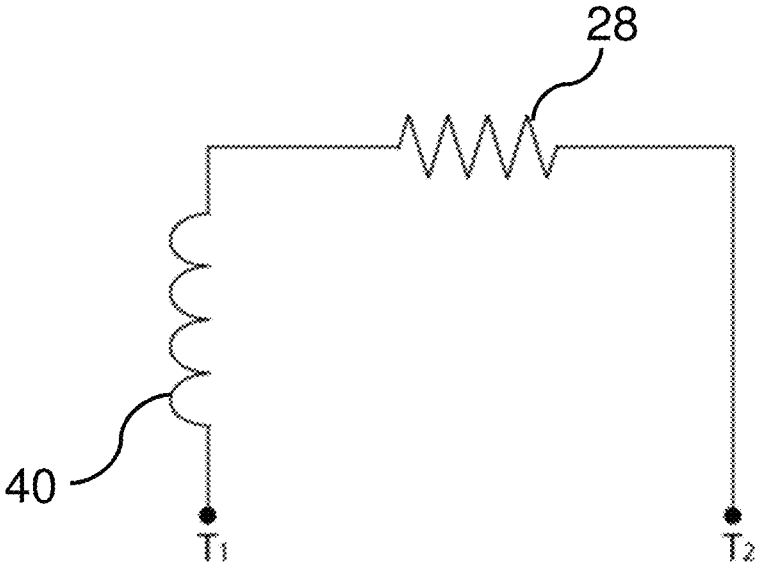
FIG. 2 is an electronic circuit diagram illustrating an example embodiment of a cartridge circuit comprising a heating element and an inductor.

FIG. 2 is an electrical circuit diagram of an example embodiment of a cartridge circuit. In this example embodiment, the heating device (e.g., heating coil 28) is connected to two electric contacts T1 and T2, which in turn are connected to the two contacts of the power source (not shown) provided in the aerosol-generating system. The cartridge circuit further includes an inductor 40 connected in series with the heating coil 28. The combination of heating device and inductor is also referred to as the "cartridge circuit" in this specification. The control circuitry 20 of the aerosol-generating system 10 is configured to determine the total inductance of the cartridge circuit, as discussed below.

As is known to those skilled in the art, the relationship between the inductance L of an electrical circuit, the voltage V, and the current I through the circuit is given by Equation (1) shown below.

$$V(t) = L\frac{dI(t)}{dt} \tag{1}$$

According to Equation (1), the voltage induced across an inductor is equal to the product of the inductor's inductance and the rate of the change of current flowing through the inductor.

By measuring the potential difference across the inductor upon a change of the current I flowing through the inductor, the control circuitry is able to determine the value of the inductor L according to the above relationship.

Having determined the value of inductor L associated with the cartridge, the control circuitry determines the cartridge type from the determined inductance value by searching a look-up table using the determined inductance value.

The look-up table may comprise one or more different inductance values, and each inductance value is associated with an identifier of a cartridge usable with the aerosol-generating system. The identifier may be indicative of the type of liquid contained within the cartridge.

The electronic control circuitry may determine the type of cartridge as the cartridge identifier stored in the look-up table, which is associated with the inductance value stored in the look-up table which is closest in value to the cartridge inductance value determined by the electronic control circuitry. The look-up table may be stored in a memory (e.g., a read only memory (ROM)) incorporated into the electronic control circuitry or may be stored in a separate memory.

Figure 3A:
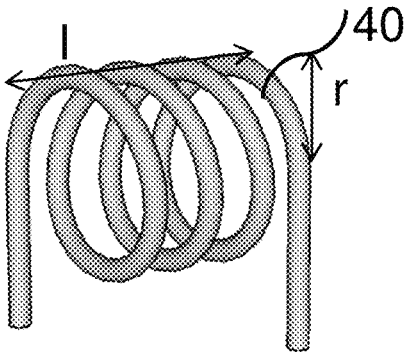
FIGS. 3A through 3C show example embodiments of inductors having identical resistance and differing inductance.
Figure 3B:
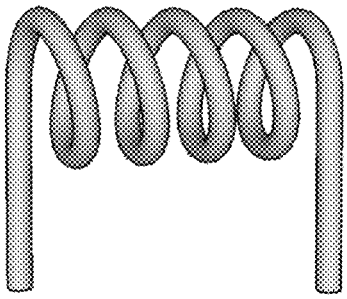
Figure 3C:
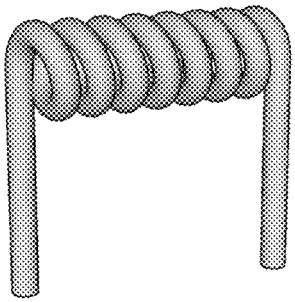

FIGS. 3A through 3C illustrate inductive coils according to example embodiments. According to these example embodiments, a copper wire with a fixed length is used to form a plurality of solenoids or inductive coils 40 having differing inductances. All coils 40 are made from an identical or substantially identical piece of copper wire, such that the electrical resistance R of these inductive coils remains constant or substantially constant.

The copper wire used in the embodiments of FIGS. 3A through 3C has a length of about 150 millimeters and a diameter of about 0.5 millimeters. Assuming a resistivity of copper of about $1.7*10^{-8}$ Ohm*meter, this results in a total resistance of the copper wire of approximately 0.01 Ohm. This resistance is sufficiently small, so that it does not affect the heater properties of the heating coil.

The copper wire is wound into a coil having a varying number of turns N and a coil radius r. For a wire having a given (or, alternatively, a desired or predefined) length l and a given (or, alternatively, a desired or predefined) number of turns N, the radius r of the resulting coil is determined according to the relationship $l=2\pi r N$ as shown below in Equation (2).

$$r = \frac{l}{2 \cdot \pi \cdot N} \tag{2}$$

The inductance of the resulting solenoid (e.g., a short cylindrical coil with air core) may be determined based on its geometrical dimensions according to Equation (3) shown below.

$$L = \frac{\mu_0 N^2 A}{l + 0.9r} = \frac{0.4 \cdot \pi^2 \cdot N^2 \cdot r^2}{l + 0.9r} \tag{3}$$

In Equation (3), the length 1 of the coil is considered to be approximately equal to the diameter of the wire multiplied by the number of turns of the coil.

The resulting dimensions and inductances for a copper wire having a total length of about 150 millimeters and a diameter of about 0.5 millimeters are indicated in Table 1 shown below.

TABLE 1

Inductance values for coils with varying number of turns and radius

| N No. of turns | Radius r (millimeters) | Length l (millimeters) | Inductance L (Microhenry) |
|---|---|---|---|
| 10 | 2.39 | 5 | 0.31 |
| 12 | 1.99 | 6 | 0.29 |
| 14 | 1.71 | 7 | 0.26 |
| 16 | 1.49 | 8 | 0.24 |
| 18 | 1.33 | 9 | 0.22 |
| 20 | 1.20 | 10 | 0.20 |

The individual coils may be reproduced as exactly as possible, such that the electronic circuit is able to distinguish in a reliable way between these inductance values. The accuracy of the method for forming the inductive coils having a particular inductance is greater than or equal to about +/−5%.

The electronic control circuit 20 determines the inductance value of the cartridge circuit in order to verify the type of cartridge 16, and thus, the type of the aerosol-forming substrate 24 provided in the currently inserted cartridge 16. Having determined the type of the aerosol-forming substrate 24, the electronic control circuitry 20 may adjust the settings for activation of the heating coil 28 to the specific type of aerosol-forming substrate 24. In this way, improved and/or optimum vaporization conditions may be achieved for a wider variety of aerosol-forming substrates 24 usable with the aerosol-generation system 10.

Example embodiments described above are not limiting. In view of the above discussed example embodiments, other example embodiments consistent with the above-discussed example embodiments will be apparent to one of ordinary skill in the art.

What is claimed is:

1. A cartridge for an electronic vaping device, the cartridge comprising:

a pre-vapor formulation storage element containing a pre-vapor formulation substrate, the pre-vapor formulation storage element defining a central air flow channel between a first end and a second end of the cartridge;

a wick including ends extending through the pre-vapor formulation storage element and a central portion of the wick extending across the central air flow channel, wherein the central portion of the wick is surrounded by a heating coil, and wherein the heating coil connects to first electrical contacts; and an electrical inductor having an inductance indicative of the pre-vapor formulation substrate contained in the pre-vapor formulation storage element, the electrical inductor has a first end extending at least partially within the pre-vapor formulation storage element, wherein the first end of the electrical inductor connects to the heating coil, and wherein the electrical inductor has a second end extending partially outside the pre-vapor formulation storage element and connecting with at least one of the first electrical contacts located at the second end of the cartridge;

wherein the second end of the cartridge is configured to be detachably couple to an end of a control section of the electronic vaping device.

2. The cartridge according to claim 1, further comprising:

the heating coil electrically connected in series with the electrical inductor to form a cartridge circuit.

3. The cartridge of claim 2, wherein the cartridge circuit has an electrical inductance value indicative of the pre-vapor formulation substrate contained in the pre-vapor formulation storage element.

4. The cartridge of claim 3, wherein the electrical inductance value corresponds to one of a plurality of electrical inductance values stored in a memory at the electronic vaping device.

5. The cartridge of claim 4, wherein the memory is a look-up table including the plurality of electrical inductance values;

the plurality of electrical inductance values are for a plurality of electrical inductors; and each of the plurality of electrical inductance values is associated with data identifying a type of pre-vapor formulation substrate.

6. The cartridge according to claim 2, further comprising:

the first electrical contacts at the second end of the cartridge, the first electrical contacts configured to be electrically connect to electronic control circuitry of the control section of the electronic vaping device; wherein the first electrical contacts are point contacts, rectangular contacts, circular contacts, or concentric ring contacts.

7. The electronic vaping device according to claim 6, wherein the second end of the cartridge includes exactly two first electrical contacts; and the first electrical contacts are configured to provide power to the heating coil and allow for determining an electrical inductance value of the cartridge circuit while providing power to the heating coil.

8. The electronic vaping device according to claim 1, wherein the electrical inductor has a first inductance value.

9. The electronic vaping device according to claim 1, wherein the inductance of the electrical inductor is based on at least one of a number of turns, a diameter of the turns, or a length of the electrical inductor.

10. The electronic vaping device according to claim 1, wherein the inductance of the electrical inductor is based on a number of turns, a diameter of the turns, and a length of the electrical inductor.

* * * * *